US006206602B1

(12) United States Patent
Yamamoto et al.

(10) Patent No.: US 6,206,602 B1
(45) Date of Patent: Mar. 27, 2001

(54) "SEE-THROUGH" BINDER WITH PRINTED FRAME COVER

(75) Inventors: Norman Yamamoto, Yorba Linda; Bruce Allen Carter, Lake Forest; Tom Wien, Newport Beach, all of CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/361,929

(22) Filed: Jul. 27, 1999

(51) Int. Cl.[7] ..... B42D 15/00

(52) U.S. Cl. ..... 402/73; 402/70; 281/29; 281/31; 281/37

(58) Field of Search ..... 281/29, 31, 37; 402/70, 73

(56) References Cited

U.S. PATENT DOCUMENTS

| | | | | |
|---|---|---|---|---|
| 1,201,700 | * | 10/1916 | Cohen | 281/29 |
| 2,289,118 | | 7/1942 | Hatton . | |
| 2,533,590 | | 12/1950 | Kutik, Jr. . | |
| 2,537,135 | | 1/1951 | Hempel . | |
| 2,583,403 | | 1/1952 | Wiser . | |
| 2,598,755 | * | 6/1952 | Birch | 40/158 |
| 2,790,651 | | 4/1957 | Winstead . | |
| 3,206,225 | | 9/1965 | Oleson . | |
| 3,565,462 | * | 2/1971 | Gottlieb | 281/37 |
| 4,244,762 | | 1/1981 | Holson . | |
| 4,267,655 | | 5/1981 | Holson . | |
| 4,332,095 | * | 6/1982 | Tanney | 40/158 R |
| 4,351,123 | | 9/1982 | Cross . | |
| 4,566,721 | | 1/1986 | Friedman et al. . | |
| 4,629,349 | | 12/1986 | Pitts . | |
| 4,795,194 | | 1/1989 | Etheredge . | |
| 4,830,404 | * | 5/1989 | Lu | 281/2 |
| 4,907,823 | * | 3/1990 | Windish | 281/31 |
| 4,914,842 | | 4/1990 | Lieberman . | |
| 5,114,009 | | 5/1992 | Johnston . | |
| 5,178,414 | | 1/1993 | Small et al. . | |
| 5,222,825 | * | 6/1993 | Wyant | 402/73 |
| 5,259,136 | | 11/1993 | Goserud . | |
| 5,393,158 | | 2/1995 | Dall'Arancio . | |
| 5,445,417 | * | 8/1995 | Bromer et al. | 281/31 |
| 5,461,810 | | 10/1995 | Goserud . | |
| 5,569,503 | | 10/1996 | Plotroski . | |
| 5,618,061 | * | 4/1997 | Ritterling | 281/29 |
| 5,785,445 | | 7/1998 | Podosek et al. . | |
| 5,799,978 | | 9/1998 | Grinnell . | |
| 5,857,797 | * | 1/1999 | Streff et al. | 402/4 |
| 5,876,143 | * | 3/1999 | Ong | 402/3 |

* cited by examiner

*Primary Examiner*—Willmon Fridie, Jr.
(74) *Attorney, Agent, or Firm*—Oppenheimer Wolff & Donnelly

(57) ABSTRACT

A cost effective binder provides high visual impact by employing a binder cover material which is transparent, and which has imprinted thereon a frame, and which is also provided with a pocket formed of thin plastic material on the inside of the cover. Visual material may be slid into this pocket and may be visible through the front cover of the binder, and is set off and emphasized by the frame formed by the coating.

22 Claims, 3 Drawing Sheets

"SEE-THROUGH" BINDER WITH PRINTED FRAME COVER

FIELD OF THE INVENTION

This invention relates to binders, such as three-ring binders, of the type having a visible sheet supplied by the user which is presented within a frame on the front of the binder.

BACKGROUND OF THE INVENTION

Binders of the type identified above are becoming quite popular. In one known prior art binder, the entire opaque cover of a binder has a transparent sheet extending over the cover, with the transparent sheet being secured to it on three sides to form a pocket into which visual presentation sheets may be inserted. However, such arrangements may be somewhat unfinished or unprofessional in their appearance.

In another more elaborate type of binder, as shown in U.S. Pat. No. 5,857,797 granted Jan. 12, 1999, for example, the binder covers may be formed of stiff opaque material covered with opaque plastic sheet material; and the opaque plastic sheet material may form a frame around a transparent front sheet pocket, thus setting off the visual material which may be inserted into the front cover pocket. However, binders of this type require different materials and a number of manufacturing steps which make the binders somewhat more expensive than would be desirable for some applications.

SUMMARY OF THE INVENTION

Accordingly, one object of the invention is to provide a simple and inexpensive binder configuration which still has substantially all of the features, including the frame surrounding the visual material, in a binder of the type described in the preceding paragraph.

In accordance with one specific illustrative embodiment of the invention, the covers of a ring binder are formed from a single sheet of fairly stiff, semi-flexible transparent plastic, which are formed to provide a spine, with the front and rear covers extending out substantially parallel from the spine; and with a paper holding ring mechanism mounted at or near the spine. The inside of the front cover has a coating applied thereto, with an open area in a central or intermediate area of the coating. A plastic sheet pocket is secured to the inner surface of the binder along three sides of the pocket, leaving an opening into which visual material may be inserted by the user, for viewing through the cover. The three edges of the pocket are preferably secured to uncoated areas of the inner surface of the front cover for secure fastening thereto.

The covers and spine may be formed of polypropylene or any other suitable transparent plastic, and the coating is preferably silk-screened onto the inner surface of the front cover, using ultraviolet (UV) curable ink.

Concerning the geometry of the coating, it will include a central or intermediate open area through which the visual material may be seen. One desirable geometry involves retaining a coating-free zone, perhaps ¼-inch or 3/16-inch wide, around the periphery of the front cover, and then providing a peripheral coating perhaps ½-inch to two inches wide around the edge of the cover just inside the bare edge zone, to provide a frame effect. The inner pocket (which may be opaque or translucent) may be heat-bonded on three sides to the bare outer edge of the inside surface of the front cover of the binder. Then, when visual material is inserted into the pocket, it appears through the transparent cover, with the coating providing a frame effect, setting off and enhancing the visual material.

Alternatively, the thin plastic sheet forming the pocket may be secured to the inner side of the front cover of the binder just inside the peripheral coated area. Particularly when the window or central open area of the coating is relatively small, this arrangement is convenient for holding the visual material in the desired location.

The principles as described above are applicable to other types of binders, such as those where a number of pages or pockets are secured within a binder, without a ring mechanism. In binders of this type, for example, where a series of pockets are bound into a binder, and where at least one side of the pocket is transparent, the visual material to be viewed through the binder cover may be inserted into the initial pocket "page" of the binder.

It is also noted that the transparent cover may be used with a binder wherein the spine and back cover are opaque or are made of different material or materials.

Other objects, features and advantages of the invention will become apparent from a consideration of the following detailed description, in combination with the accompanying drawings.

DETAILED DESCRIPTION OF PREFERRED EMBODIMENTS OF THE INVENTION

Figure 1:
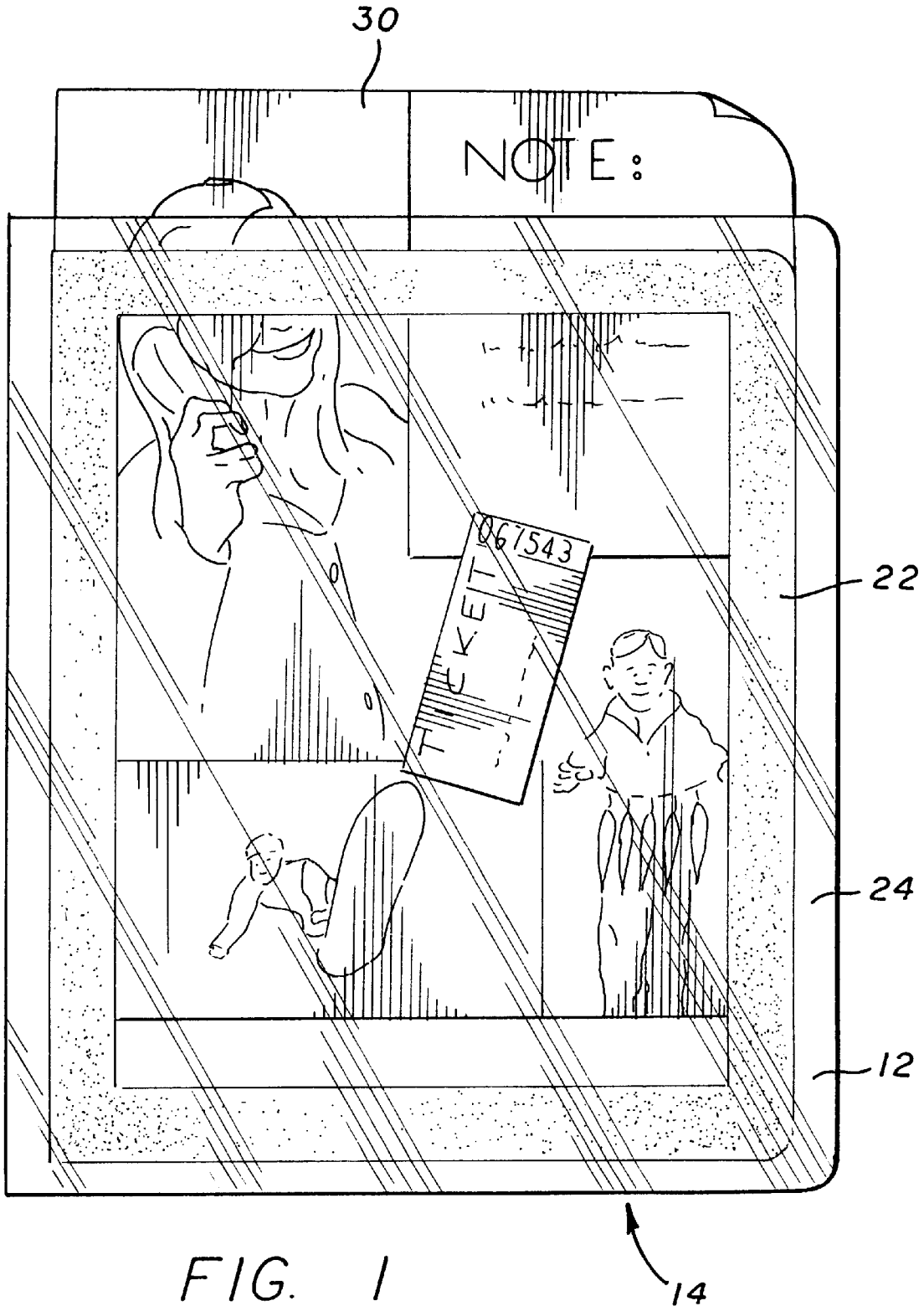
FIG. 1 is a plan view of the front of a binder illustrating the principles of the invention, with the visual insert sheet partially removed.
Figure 2:
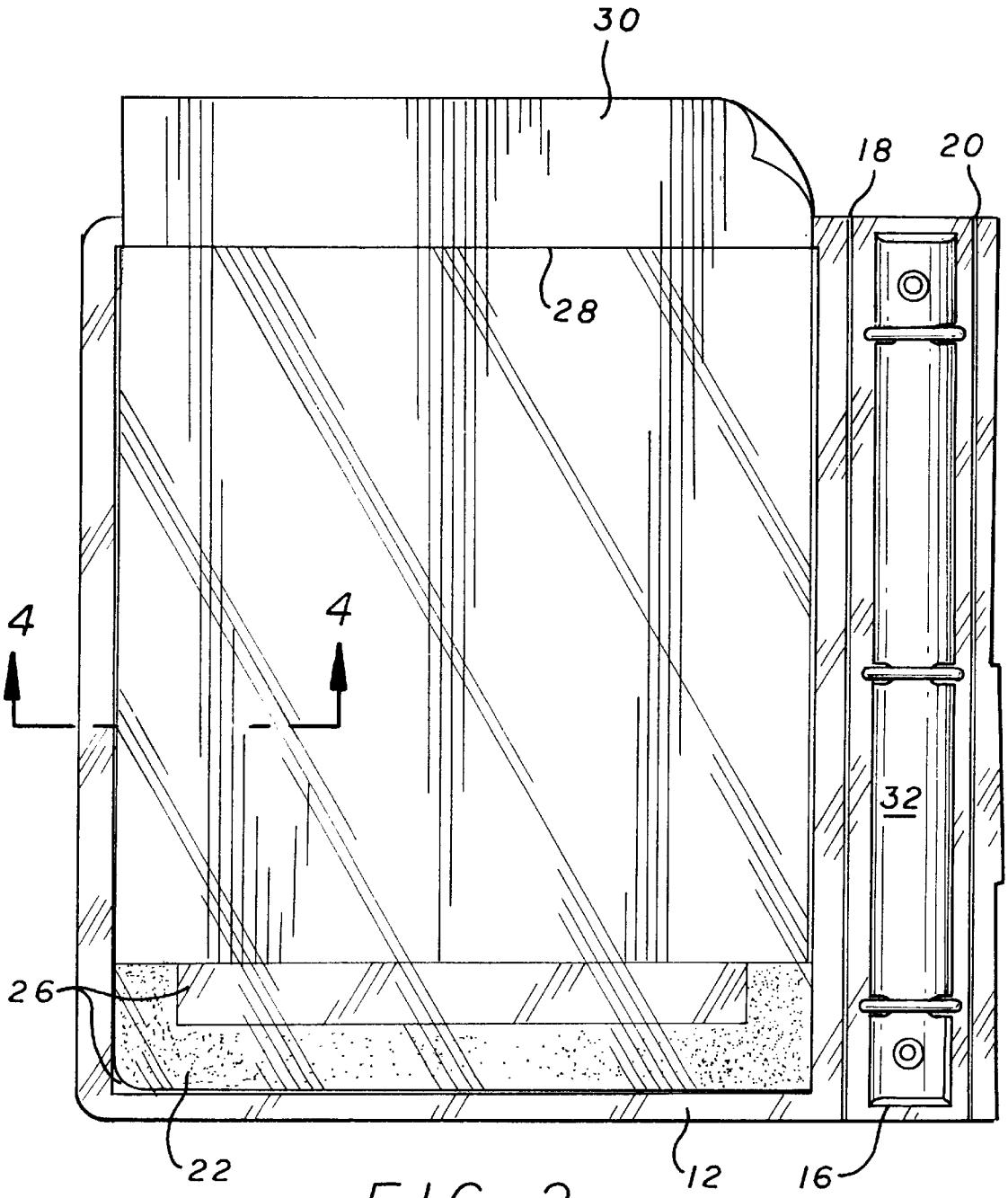
FIG. 2 is a plan view of the inside front cover of the binder of FIG. 1 with the sheet bearing visual display material again being partially removed from the inner pocket.

Referring more particularly to the drawings, FIG. 1 shows a front cover 12 of a three-ring binder 14 with the cover being formed of transparent plastic material. The binder may, by way of example, be formed of polypropylene several tens of thousands of an inch thick so that it is fairly stiff, but somewhat flexible. By way of example, the front cover, the rear cover and the spine of the binder may be formed of 35 gauge polypropylene which is 0.035 inch thick. The sheet of transparent plastic may be heat formed on either side of the spine 16, as shown in FIG. 2, so that the front and rear covers extend out substantially parallel, and are bendable in the area where the plastic has been heat formed and is somewhat thinner, for example at lines 18 and 20 in FIG. 2.

Returning to FIG. 1, it may be noted that the outer edges 24 of the front cover are preferably free of any coating material, while a coating 22 provides an opaque frame extending around the periphery of the front cover of the binder just within the coating-free area 24. On the inside of the front cover 12, as best shown in FIG. 2, a thin plastic sheet 26 is heat bonded directly to the polypropylene front cover just outside the frame coating 22, on the bottom and on the two sides of the inner face of the front cover of the binder. The upper edge 28 of the plastic sheet material 26 is left open, to permit the insertion of the visual display material 30 which is shown in both FIGS. 1 and 2 as extending outwardly from the binder 14, as though it is just being inserted or just being removed from the pocket formed by the sheet material 26.

A conventional three-ring binder mechanism 32 may be mounted to the spine 16, or to the rear cover immediately adjacent the spine 16, as desired.

Figure 3:
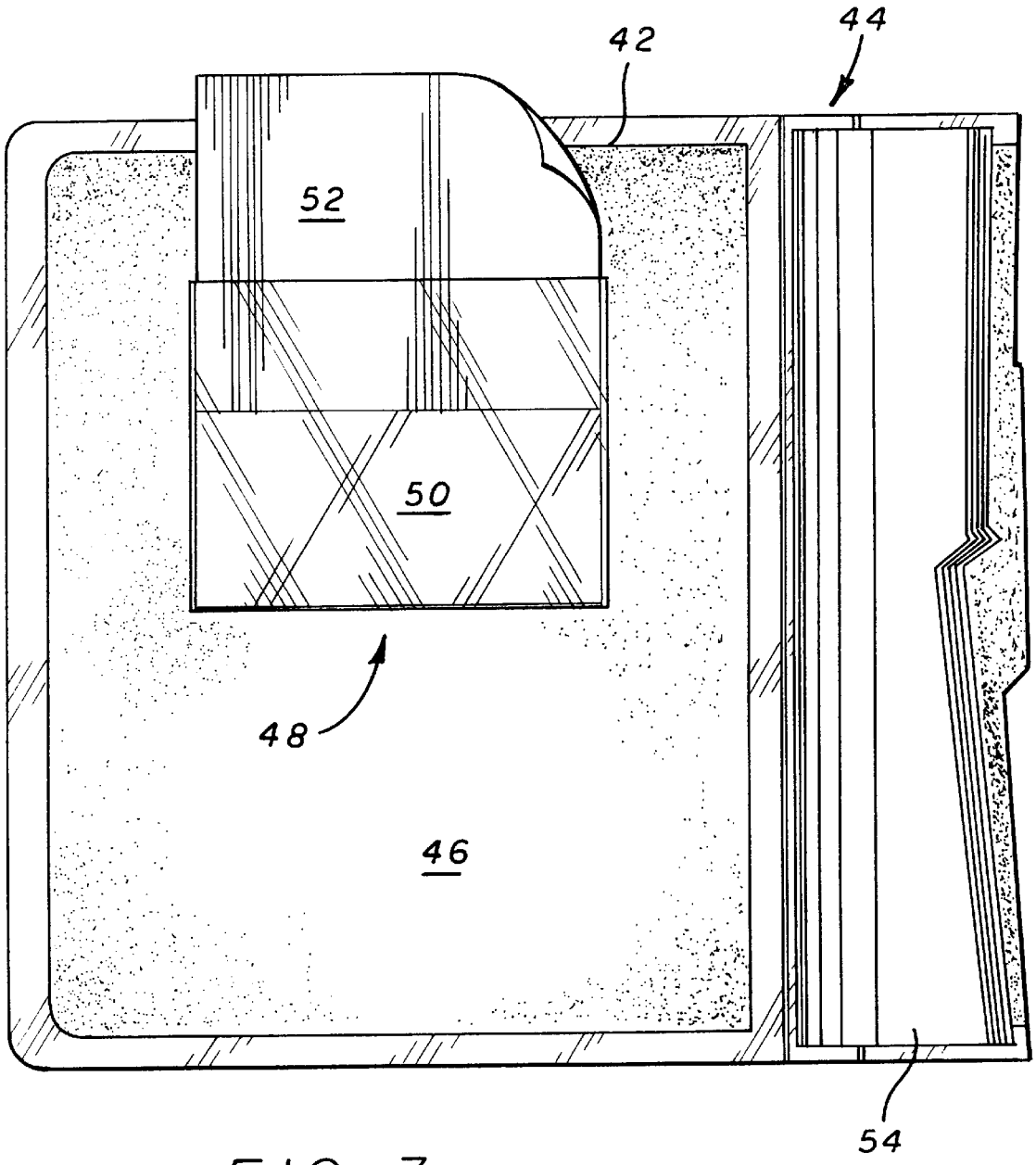
FIG. 3 is a view of the inside front cover on an alternative embodiment of the invention in which a smaller pocket for visual material is provided.

In a second embodiment of the invention as shown in FIG. 3, the front cover 42 of the binder 44 has an opaque coating 46 which is of substantially greater extent than the opaque frame coating 22 of FIG. 1. In the embodiment of FIG. 3, the relatively small area 48 is uncoated, and has secured thereto a thin sheet of plastic 50. Printed visual material on the front face of the insert sheet 52 is visible through the front of the cover, when the sheet 52 is inserted all the way into the pocket provided by the thin plastic sheet 50. Again, as in the case of the embodiment of FIGS. 1 and 2, the thin sheet plastic material which forms the pocket is preferably secured to the cover in uncoated areas so as to provide a more secure bond. In this regard, it is noted that in the embodiment of FIG. 3, the opaque coating 46 could extend to the outer edges of the front cover of the binder.

In the binder of FIG. 3, there is no ring mechanism, but a series of pages 54 are securely bound into the binder 44. These pages 54 may, for example, be a series of plastic pockets with transparent front portions and with the back of the pocket being formed of thin opaque plastic material. Other types of binders may, of course, be employed. If desired, the top page 54 (which is a plastic pocket) of the contained sheet material may include visual material in the pocket which may be seen through the transparent cover; and when this arrangement is used, the pockets on the inner surface of the binder cover may or may not be used.

Figure 4:
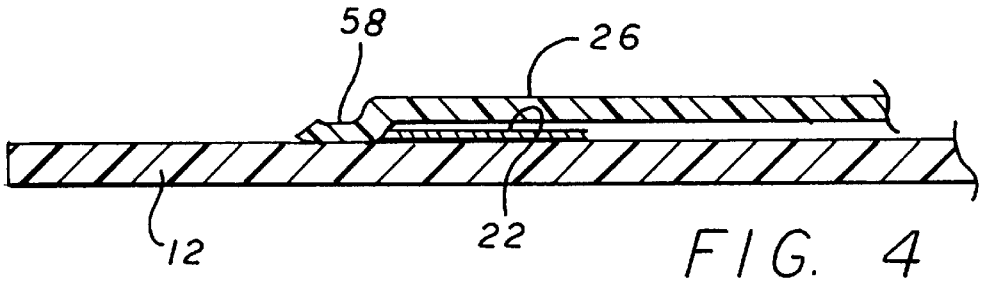
FIG. 4 is a cross-sectional view of the edge of the front cover of the binder, taken along lines 4—4 of FIG. 2.

Turning now to FIG. 4, it is a cross-sectional view taken along lines 4—4 of FIG. 2. Shown in FIG. 4 are the cover 12, the coating 22, and the sheet plastic material 26, which may be heat bonded to the cover 12 along the line indicated at 58 in FIG. 4.

Concerning one feature of the invention, using a standard size notebook and a printed frame of an inch or so in width, and securing the pocket within the frame, it was found that standard 8½" by 11" sheets or A-4 paper sheets, would not fit into the pocket. However, by providing an uncoated or bare outer periphery of the binder cover, and securing the pocket to this bare outer border, 8½" by 11" sheets are readily accommodated. This configuration, permitting the use of standard sheet size visual material, is an added convenience provided by this embodiment of the invention.

In closing, it is to be understood that the foregoing detailed description and the accompanying drawings are of illustrative embodiments of the invention. Various changes and modifications may be employed without departing from the spirit and scope of the invention. Thus, by way of example and not of limitation, the invention is applicable to virtually any type of binder, particularly to binders of different sizes and with different mechanisms or arrangements, which may or may not include metallic rings, for holding pages within the binder. Plastic materials other than polypropylene may be employed. The inner transparent sheet material forming the pockets may be either opaque or transparent. The coating forming the frame is preferably on the inner surface of the front cover, but may be on the outer surface thereof. Various thicknesses of plastic materials may be employed, with the thicker plastic sheet materials being more stiff, and the thinner thicknesses providing a binder which is more flexible.

It is also noted that the pockets may be secured in place by heat bonding, by ultrasonic welding, by RF welding, or any other technique providing secure mounting of the pocket. As disclosed above, the pockets are preferably bonded to the uncoated areas of the inner surface of said binder in order to provide a stronger bond; however, in some cases where the coating, the plastic materials, and the method of bonding permit secure bonding of the pocket in the coated areas, this alternative may be used. Accordingly, the present invention is not limited to the specific embodiments shown in the drawings and described in the foregoing detailed description.

What is claimed is:

1. A cost-effective binder with high visual impact, comprising:

front and rear covers joined at a spine;

said front cover being formed of sheet plastic material which is transparent; said front cover having an outer surface and an inner surface;

said front cover having an imprinted coating on the inner surface thereof forming a printed frame, with areas of said inner surface of said front cover being free of said coating, and providing a central area free of coating within said printed frame; and a pocket formed of sheet plastic material secured to the inner surface of said front cover at areas of said cover which are free of said coating with at least some areas of said pocket being coextensive with said central area within said frame;

whereby visual material is insertable into said pocket, so that said visual material is visible through said front cover following insertion into said pocket, and is set off or emphasized by said printed frame.

2. A binder as defined in claim 1 wherein said front cover has outer edges which are free of said coating and wherein said sheet plastic material is secured to said outer edges to form a large pocket for visual material.

3. A binder as defined in claim 1 wherein said pocket is located within said printed frame.

4. A binder as defined in claim 1 wherein said front and rear covers and the spine are made of a single sheet of semi-flexible plastic, with the sheet being formed along lines extending between the spine and each of the covers so that the covers extend substantially parallel to one another.

5. A cost-effective binder with high visual impact, comprising:

front and rear covers joined at a spine;

said front cover being formed of sheet plastic material which is transparent; said front cover having an outer surface and an inner surface;

said front cover having an imprinted coating thereon forming a printed frame, with areas of said inner surface of said front cover being free of said coating; and a pocket formed of sheet plastic material secured within said binder in a configuration with said pocket aligned with said areas of said front cover which are free of said coating and within said frame;

whereby visual material is insertable into said pocket, so that said visual material is visible through said front cover following insertion into said pocket, and is set off or emphasized by said printed frame.

6. A cost-effective binder with high visual impact, comprising:

front and rear covers joined at a spine;

said front cover being formed of sheet plastic material which is transparent, said cover having an outer surface and an inner surface;

said front cover having an imprinted coating on the inner surface thereof forming a printed frame, with areas of said inner surface of said front cover being free of said coating;

a pocket formed of sheet plastic material, secured on three sides to unprinted areas of the inside front cover of said binder; and said front cover having outer edges which are free of said coating and said sheet plastic material being secured to said outer edges to form a large pocket for visual material;

whereby visual material is insertable into said pocket, so that said visual material is visible through said front cover, and is set off or emphasized by said printed frame.

7. A binder as defined in claim 5 wherein at least three of the outer edges of said front cover are free of said coating and wherein said sheet plastic material is secured to said outer edges to form a large pocket for visual material.

8. A binder as defined in claim 5 wherein said pocket is located within said printed frame.

9. A binder as defined in claim 5 wherein said front and rear covers and the spine are made of a single sheet of semi-flexible plastic, with the sheet being formed along lines extending between the spine and each of the covers so that the covers extend substantially parallel to one another.

10. A binder as defined in claim 1 wherein said coating is ink.

11. A binder as defined in claim 1 wherein said coating is an ultraviolet curable coating.

12. A binder as defined in claim 1 wherein said front cover is made of polypropylene.

13. A binder as defined in claim 1 further comprising visual material on a separate sheet mounted within said pocket.

14. A binder as defined in claim 1 including a ring mechanism for retaining pages within said binder.

15. A binder as defined in claim 1 including means for retaining pages within said binder.

16. A binder as defined in claim 10 wherein said coating is ink.

17. A binder as defined in claim 10 wherein said coating is an ultraviolet curable coating.

18. A binder as defined in claim 10 wherein said front and rear covers and the spine are made of a single sheet of semi-flexible plastic, with the sheet being formed along lines extending between the spine and each of the covers so that the covers extend substantially parallel to one another.

19. A binder as defined in claim 10 wherein said front cover is made of polypropylene.

20. A binder as defined in claim 10 further comprising visual material on a separate sheet mounted within said pocket.

21. A binder as defined in claim 10 including a ring mechanism for retaining pages within said binder.

22. A binder as defined in claim 10 including means for retaining pages within said binder.

* * * * *